US008275295B2

(12) United States Patent
Serizawa et al.

(10) Patent No.: US 8,275,295 B2
(45) Date of Patent: Sep. 25, 2012

(54) TONER CONTAINER AND TONER FILLING METHOD

(75) Inventors: Masato Serizawa, Ebina (JP); Katsumi Harumoto, Saitama (JP); Kazuyuki Yamagishi, Minamiashigara (JP); Keisuke Shinoda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/205,272

(22) Filed: Sep. 5, 2008

(65) Prior Publication Data

US 2009/0035010 A1 Feb. 5, 2009

Related U.S. Application Data

(62) Division of application No. 11/520,599, filed on Sep. 14, 2006, now Pat. No. 7,437,101.

(30) Foreign Application Priority Data

May 25, 2006 (JP) ..... 2006-145501

(51) Int. Cl.
*G03G 15/08* (2006.01)

(52) U.S. Cl. ..... 399/262; 399/258

(58) Field of Classification Search ..... 399/119, 399/120, 24, 224, 255, 258, 106, 102, 103, 399/262

See application file for complete search history.

(56) References Cited

U.S. PATENT DOCUMENTS

| | | | | |
|---|---|---|---|---|
| 4,441,636 | A * | 4/1984 | Yamashita et al. | 222/541.6 |
| 4,599,851 | A * | 7/1986 | Williams | |
| 4,963,939 | A * | 10/1990 | Kurando et al. | |
| 4,972,887 | A | 11/1990 | Hacknauer et al. | |
| 5,303,008 | A | 4/1994 | Kalyandurg et al. | |
| 5,585,902 | A * | 12/1996 | Nishiuwatoko et al. | 399/106 |
| 5,722,019 | A | 2/1998 | Nakajima | |
| 6,097,907 | A | 8/2000 | Fujiwara | |
| 6,219,506 | B1 * | 4/2001 | Morinaga et al. | 399/109 |
| 6,246,848 | B1 | 6/2001 | Morinaga et al. | |
| 2005/0002684 | A1 * | 1/2005 | Suzuki | 399/109 |
| 2005/0286936 | A1 * | 12/2005 | Huang et al. | 399/262 |
| 2006/0083540 | A1 | 4/2006 | Kadowaki et al. | |
| 2006/0171737 | A1 * | 8/2006 | Nishimura et al. | 399/109 |
| 2008/0145094 | A1 * | 6/2008 | Nakamura et al. | 399/109 |

FOREIGN PATENT DOCUMENTS

JP 1-64656 U 4/1989

(Continued)

OTHER PUBLICATIONS

Japanese Office Action dated Jun. 7, 2011 for Japanese Patent Application 2006-145501.

*Primary Examiner* — David Gray
*Assistant Examiner* — G. M. Hyder
(74) *Attorney, Agent, or Firm* — Sughrue Mion, PLLC

(57) ABSTRACT

A toner container which is mountable and removable at a main body of an image forming apparatus, the toner container comprising: at least one toner filling port provided in a casing body of the toner container; and a sealing member which covers the toner filling port and a predetermined range of surroundings of the toner filling port, from an outer side of the casing body, for sealing toner inside the casing body, is provided.

8 Claims, 12 Drawing Sheets

FOREIGN PATENT DOCUMENTS

| | | | |
|---|---|---|---|
| JP | 6-148969 | A | 5/1994 |
| JP | 7-049611 | A | 2/1995 |
| JP | 10-90985 | A | 4/1998 |
| JP | 10-104925 | A | 4/1998 |
| JP | 11-109753 | A | 4/1999 |
| KR | 20-0332698 | Y1 | 11/2003 |
| KR | 10-2005-0039810 | A | 4/2005 |

* cited by examiner

TONER CONTAINER AND TONER FILLING METHOD

CROSS REFERENCE TO RELATED APPLICATION

This application is a Divisional of application Ser. No. 11/520,599 filed Sep. 14, 2006 which claims priority under 35 U.S.C. §119 from Japanese Patent Application 2006-145501 filed May 25, 2006. The entire disclosures of the prior applications, application Ser. Nos. 11/520,599 and JP 2006-145501 are considered part of the disclosure of the accompanying divisional application and are hereby incorporated by reference.

BACKGROUND

1. Technical Field

The present invention relates to a toner container and a toner filling method, and more particularly relates to a toner container and toner filling method to be employed at an image forming apparatus which employs static electricity to form toner images.

2. Related Art

Heretofore, among image forming apparatuses such as photocopiers, laser printers and the like which utilize an electrophotography system, image forming apparatuses have been widely known that are of a mode in which a toner container filled with toner is removably mounted at the image forming apparatus and, when the toner filled in the toner container has been consumed and the toner container is empty, the toner container is replaced and new toner is supplied.

Among toner containers for supplying toner to such image forming apparatuses, there are: a bottle form with a single-layer structure, in which toner is supplied to an apparatus main body simply by a supply port of the toner container being fitted to an intake port of the main body and a seal member which seals up the supply port being removed; a cylinder form with a multi-layer structure, in which a tubular-form inner case is fitted into a tubular-form outer case and the inner case is rotated; and so forth.

SUMMARY

According to an aspect of the invention, there is provided a toner container which is mountable and removable at a main body of an image forming apparatus, the toner container comprising: at least one toner filling port provided in a casing body of the toner container; and a sealing member which covers the toner filling port and a predetermined range of surroundings of the toner filling port, from an outer side of the casing body, for sealing toner inside the casing body.

BRIEF DESCRIPTION OF THE DRAWINGS

Exemplary embodiments of the present invention will be described in detail based on the following FIGS., wherein.

DETAILED DESCRIPTION

First, schematics of an image forming apparatus 10 pertaining to the present invention will be described.

-Basic Structure-

Figure 1:
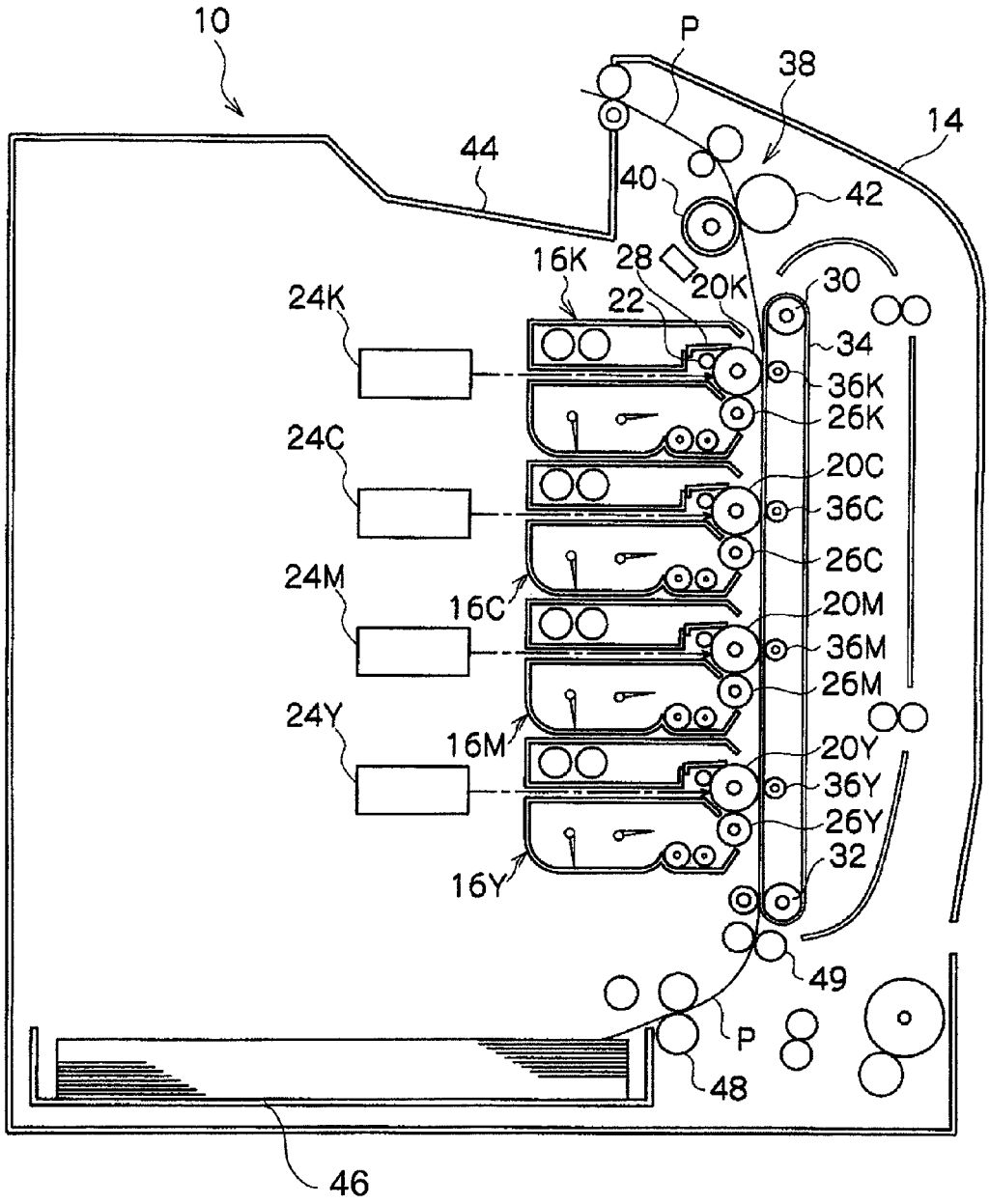
FIG. 1 is a schematic view showing an image forming apparatus pertaining to the present invention.
Figure 2:
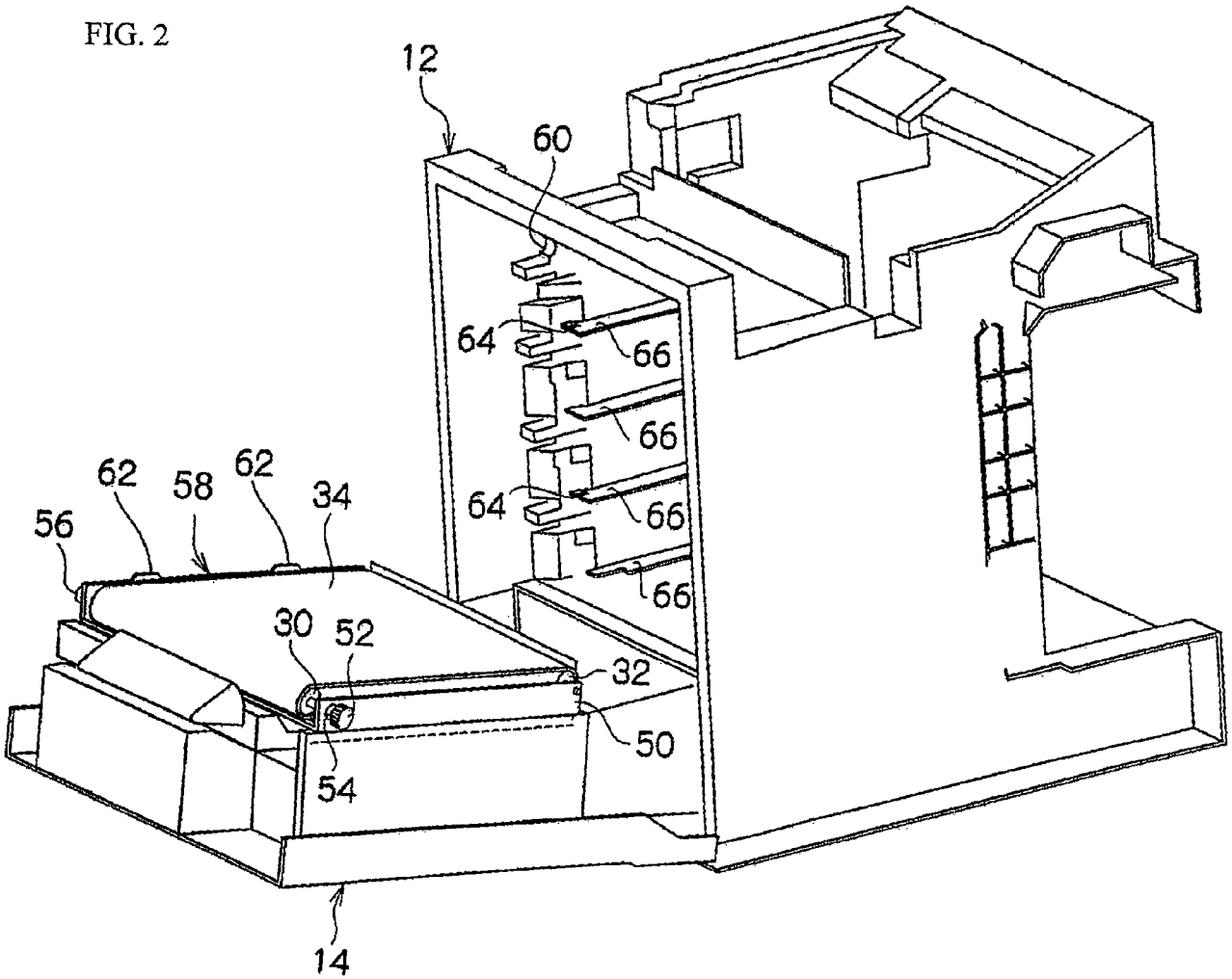
FIG. 2 is a perspective view showing the image forming apparatus pertaining to the present invention.

FIGS. 1 and 2 show basic structure of an image forming apparatus pertaining to the present invention.

An example of a drum-type four-color image forming apparatus pertaining to the present invention is shown in FIGS. 1 and 2.

As shown in FIGS. 1 and 2, the image forming apparatus 10 includes a main body frame 12, which removably accommodates image carriers (photoconductors) 20 and developing units 16, and a cover body 14, which exposes/covers the image carriers 20 and the developing units 16. A conveyance unit 58, which is provided with a conveyance belt 34 which is capable of attracting and conveying recording paper P, is removably mounted at the cover body 14.

Each developing unit 16 is provided with a charge roller 22, the image carrier 20, a developing roller 26 and a cleaning member 28. The charge roller 22 uniformly charges a surface of the image carrier 20. A latent image is formed at the image carrier 20 by an ROS (a raster output scanner, which is a scanning device for writing exposure) 24, which irradiates imaging light based on image data. The developing roller 26 selectively transfers toner to the latent image to make the latent image visible. The toner image is transferred, and then the cleaning member 28 rubs against the image carrier 20 and cleans off toner that has been left on the image carrier 20.

The image carrier 20 includes a photosensitive layer at a surface thereof (i.e., a peripheral surface). After this surface (the peripheral surface) has been uniformly charged by the charge roller 22, the surface (the peripheral surface) is exposed with laser light (the imaging light) radiated from the ROS 24, and an electrostatic latent image (the image) is formed by potentials of exposed portions being attenuated. Herein, the charge roller 22 abuts against the image carrier 20, voltage is applied therebetween, and discharges occur in a small gap in a vicinity of the abutting portion. Thus, the surface of the image carrier 20 (the peripheral surface) is substantially uniformly charged.

The ROS 24 scans flickering laser light onto the surface (the peripheral surface) of the image carrier 20, and forms the electrostatic latent image on this surface (the peripheral surface) of the image carrier 20 in accordance with the image data. As the ROS 24, an apparatus in which light emitting diodes such as LEDs or the like are arrayed and are flickered on the basis of image data can be considered.

The developing roller 26 is arranged so as to be close to and oppose the image carrier 20, and a developing bias voltage is applied between the developing roller 26 and the image carrier 20. As a result, a developing bias electric field is formed between the developing roller 26 and the image carrier 20, and toner carrying electric charge is transferred to the exposed portions of the image carrier 20 to form a visible image.

Anyway, the conveyance unit 58 is equipped with the conveyance belt 34, which is stretched between at least a driving roller 30 and a driven roller 32. At an inner face side of the conveyance belt 34, a plurality of transfer rollers 36 (four rollers, corresponding to respective colors which will be mentioned later) are arranged with a predetermined spacing therebetween at predetermined positions between the driving roller 30 and the driven roller 32.

When the cover body 14 has been closed (i.e., when the cover body 14 has swung toward the main body frame 12 to close off the image carriers 20, etc.), the transfer rollers 36 oppose the image carriers 20 with the conveyance belt 34 sandwiched therebetween, and transfer electric fields are formed between the transfer rollers 36 and the image carriers 20. As a result, the toner images (unfixed images) on the surfaces of the image carriers 20 are transferred onto recording paper P which is being attracted and conveyed by the conveyance belt 34 and passes the transfer rollers 36.

The developing units 16 are arranged in a vertical direction in a sequence of, for example, yellow (Y), magenta (M), cyan (C) and black (K) along a direction of conveyance of the recording paper P from below, such that full-color printing is possible. At a downstream side in the conveyance direction of the recording paper P relative to these developing units 16Y to 16K (i.e., at an upper portion of the main body frame 12), a fixing device 38 is provided.

The developing units 16Y to 16K develop the electrostatic images on the image carriers 20Y to 20K with toners of yellow (Y), magenta (M), cyan (C) and black (K), respectively. The toner images that are formed are transferred onto the paper P.

The fixing device 38 is provided with a heating roller 40 and a pressure roller 42, surfaces of which oppose one another and are pressure-welded (nip) with a predetermined pressure. An unfixed toner image that has been transferred onto the recording paper P is heated and pressed by the heating roller 40 and the pressure roller 42, and thus the toner image is fixed onto this recording paper P.

The recording paper P which has been heated and pressed by the fixing device 38 (i.e., the heating roller 40 and the pressure roller 42) to fix the toner image is ejected to an ejection tray 44. After the completion of transfer of the toner images onto the recording paper P, the surfaces (the peripheral surfaces) of the image carriers 20 are subjected to cleaning processing by the cleaning members 28, and are provided to a subsequent image creation process.

A mountable and removable paper supply cassette 46 is provided at a lower portion of the main body frame 12. The paper supply cassette 46 can be pulled out in a direction opposite to a direction in which the recording paper P is fed out, and can supply the recording paper P as appropriate.

At a vicinity of a distal end portion of the paper supply cassette 46, a paper supply roller pair 48 is provided, which feeds out the recording paper P from inside the paper supply cassette 46 one sheet at a time. The recording paper P that has been fed out through the paper supply roller pair 48 is fed to an attraction and conveyance surface of the conveyance belt 34 with a predetermined timing, by a registration roller 49, and is conveyed to transfer positions of the toner images of the respective colors.

Next, the conveyance unit 58 which is removably mounted at the cover body 14 in the image forming apparatus 10 with the structure described above will be described in more detail.

The conveyance unit 58 includes a casing body 50 which is formed in a substantial rectangular frame form. The driving roller 30 is rotatably pivoted at one end portion (an upper end portion) of this casing body 50, and the driven roller 32 is rotatably pivoted at another end portion (a lower end portion) of the casing body 50. The conveyance belt 34 which is capable of electrostatically attracting the recording paper P is wound round and stretched between the driving roller 30 and the driven roller 32.

The transfer rollers 36Y to 36K for the respective colors, which are spaced apart by the predetermined spacing, are arranged between the driving roller 30 and the driven roller 32 at the inner face side of the conveyance belt 34. The transfer rollers 36Y to 36K are also rotatably pivoted at the casing body 50. When the cover body 14 has been closed, the transfer rollers 36Y to 36K press against the image carriers 20Y to 20K with a predetermined pressure, sandwich the conveyance belt 34, and rotate to follow running of the conveyance belt 34.

-Toner Cartridge-

FIGS. 3A, 3B, 4A, 4B and 4C show a toner cartridge of the image forming apparatus pertaining to a first exemplary embodiment of the present invention.

Figure 3A:
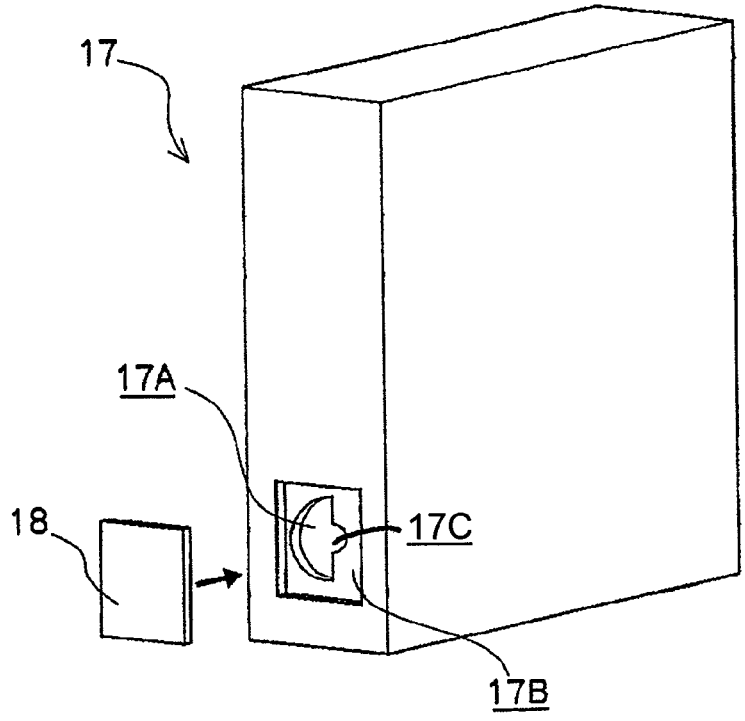
FIG. 3A is a perspective view showing a toner cartridge pertaining to the present invention.
Figure 3B:
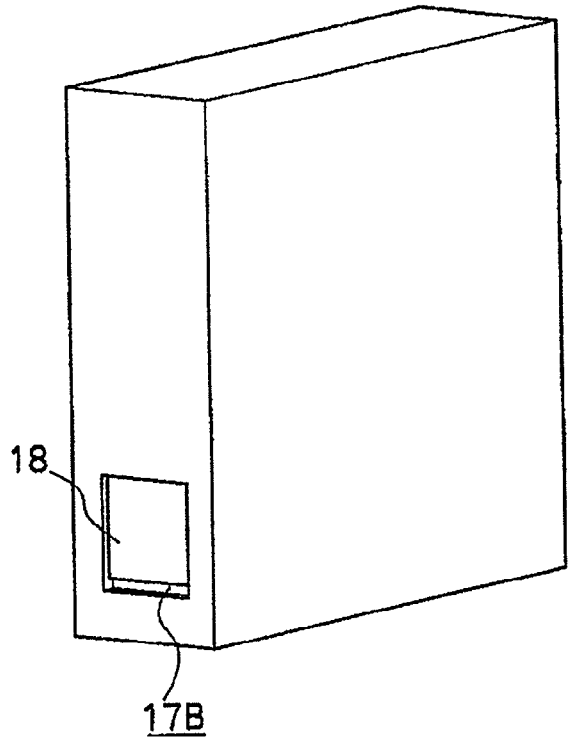
FIG. 3B is a perspective view showing the toner cartridge pertaining to the present invention.

As shown in FIGS. 3A and 3B, a toner cartridge 17 pertaining to the present invention has a structure in which a recess portion 17B and a filling port 17A for filling of toner are formed. At the recess portion 17B, a portion of a side face of the toner cartridge 17 is recessed relative to surroundings thereof A seal member 18 is adhered to cover the toner filling port 17A after toner filling.

As shown in FIG. 3A, the recess portion 17B is provided at the side face of the toner cartridge 17.

With regard to toner filling efficiency, it is desirable to avoid providing the recess portion 17B in a face with a large surface area. Thus, the recess portion 17B is consequentially formed in a face with a small surface area. Furthermore, given that the toner filling port 17A is provided within the recess portion 17B, forming the filling port 17A with a shape other than a circle is better for filling efficiency.

Specifically, if the toner filling port 17A of the toner cartridge 17 were formed in a face with a large area, given that the toner being filled is a powder, because flow characteristics of powder are poor, the toner would consequently stay in a vicinity of the filling port 17A rather than proceeding deep into the interior of the toner cartridge 17. Therefore, usually, the toner filling port 17A is provided in a side with a longitudinal direction which can make use of the filling volume of the toner cartridge 17 fully in a state in which a side face of a toner store is oriented downward and the toner cartridge 17 is stood up. This toner filling port 17A is oriented upward, and the toner is filled through a nozzle of a toner-filling machine which is inserted into the toner filling port 17A from above.

Figure 13:
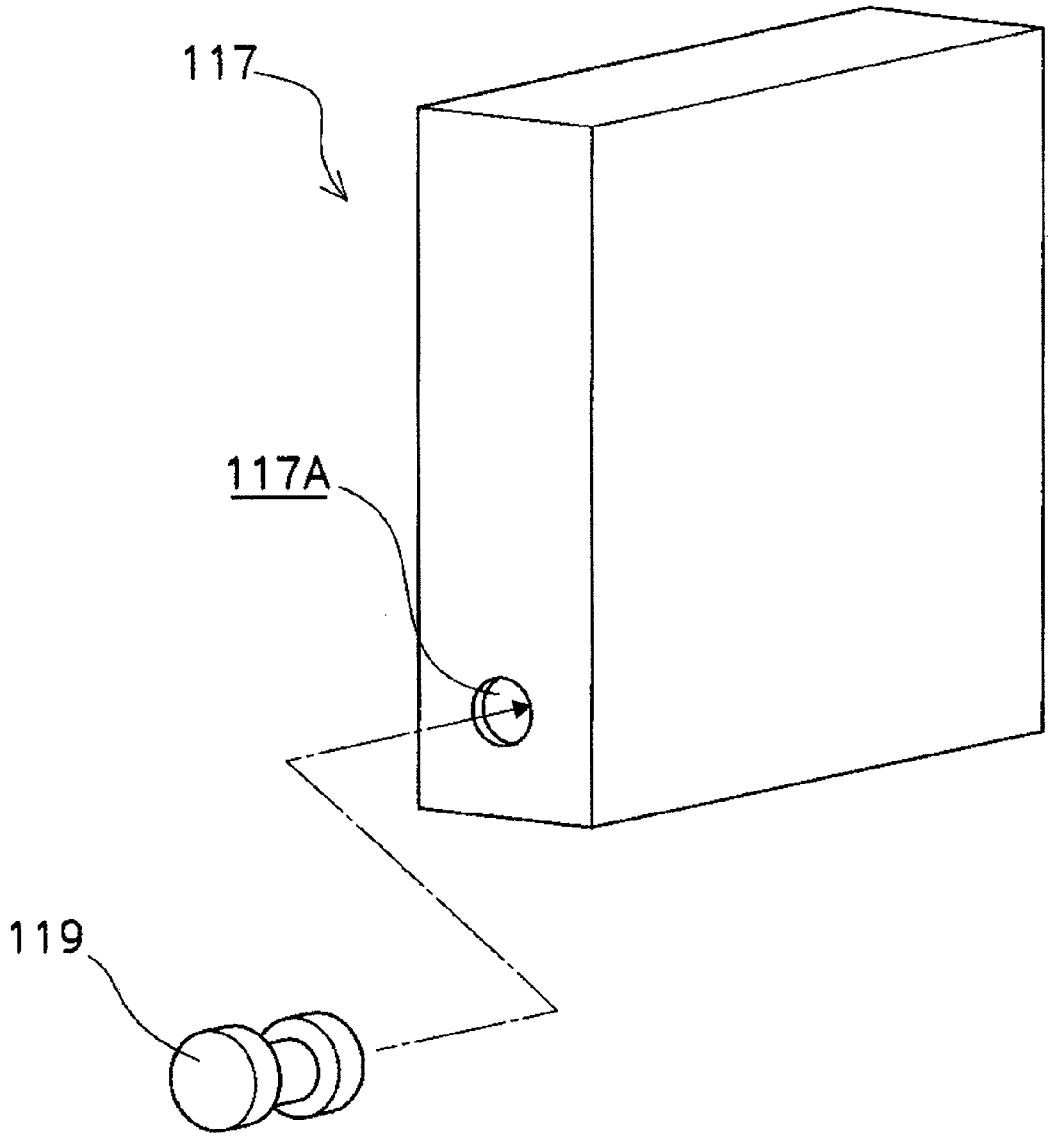
FIG. 13 is a view showing the previous toner cartridge.

Now, if a member which seals the filling port 117A is the resin cap 119 as shown in FIG. 13, it is necessary for the filling port 117A to be made circular. When the filling port 117A is circular, the diameter of the filling port 117A is dependent on the size of the face in which the filling port 117A is formed, and a circle with a size exceeding the width of the face will be inconceivable. Moreover, it is necessary for ribs or the like to be provided in order to assure strength, so the diameter of the filling port 117A will inevitably be somewhat smaller than the width of the side face.

Figures 4A, 4B, 4C:
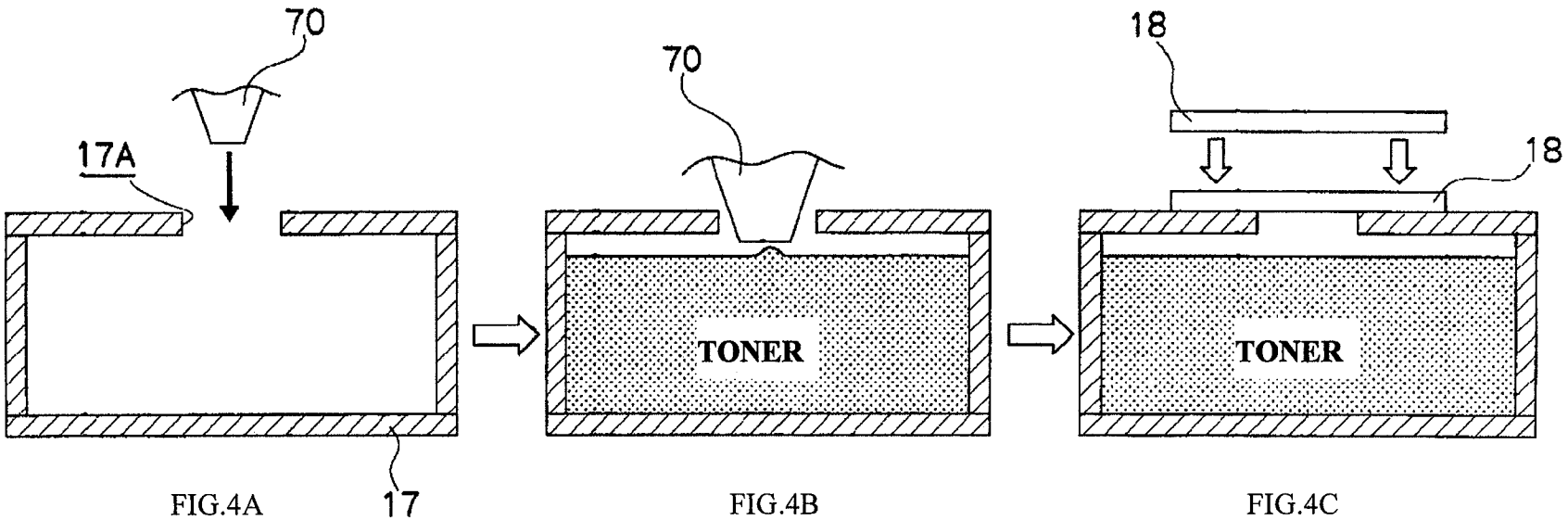
FIG. 4A is a view showing a filling process of the toner cartridge pertaining to the present invention.
FIG. 4B is a view showing the filling process of the toner cartridge pertaining to the present invention.
FIG. 4C is a view showing the filling process of the toner cartridge pertaining to the present invention.

With the present exemplary embodiment, as shown in FIG. 4A, the toner filling port 17A is not of the format in which the resin cap 119 is fitted therein, but is covered from the outer side thereof with the seal member 18. Therefore, the shape of the toner filling port 17A can be a shape other than a circle. Consequently, a degree of freedom of the shape of the toner filling port 17A is raised and, as is shown in FIG. 3A, effects of the width size of the side face can be thoroughly eliminated.

In other words, because the means for covering the toner filling port 17A is a structure which covers the toner filling port 17A from the outer side of the casing body accommodating the toner, the toner filling port 17A can be formed with an opening portion shape other than a circle (besides a round shape, a shape such as a long hole, a long rectangle or the like). Because the toner filling port 17A has a greater degree of freedom in its shape, even if the toner cartridge 17 is small and thin, filling efficiency can be improved.

When the toner is being filled through the toner filling port 17A, an air vent for releasing air inside the toner cartridge 17 to the outside is necessary. With a circular hole, such as the filling port 117A, it is necessary to provide an air vent separately at a separate location, or a measure such as employing a coaxial nozzle during filling or the like is necessary. In contrast, when the shape of the toner filling port 17A is free, as in the present exemplary embodiment, these measures are rendered unnecessary by the formation of a shape which includes an air vent 17C (for example, an incision appended to the toner filling port 17A to form an air vent 17C, or the like).

Moreover, because the toner filling port 17A is covered from the outer side of the casing body, there is no need for a formation, a space or the like to which a cap can be fitted at an interior portion of the casing body around the filling port, which would be necessary with a format in which the resin cap 119 is fitted in. Therefore, a volume of the toner cartridge 17 into which toner can be filled can be increased.

Further, as shown in FIG. 4B, after the toner-filling machine 70 has been inserted into the toner filling port 17A and toner has been charged into the toner cartridge 17, the toner filling port 17A can be reliably covered from outside by the seal member 18, as shown in FIG. 4C, regardless of the shape of the toner filling port 17A itself. Moreover, because the recess portion 17B is provided as a reference for adhesion of the seal member 18, it is possible to precisely cover the opening portion of the filling port 17A, and reliability with respect to preventing toner leakages is improved. Furthermore, a size of the seal member 18 can be made as small as possible, and costs can be reduced.

Because the member for covering the toner filling port 17A is the seal member 18, even if the shape of the toner filling port 17A is complex, the toner filling port 17A can be reliably covered, and toner leakages can be prevented.

Figure 5:
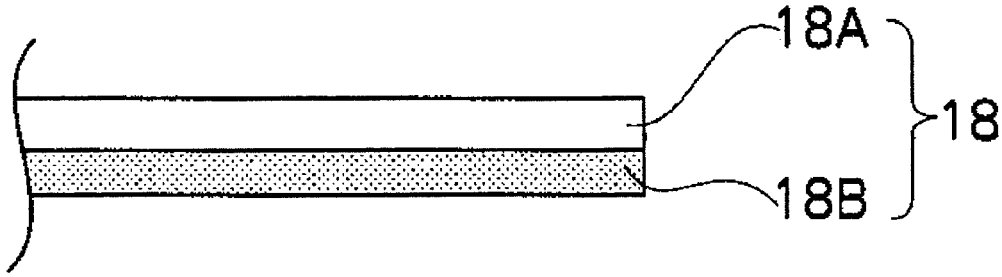
FIG. 5 is a view showing structure of a seal member pertaining to the present invention.

Here, the seal member 18 may be formed with a two-layer structure as shown in FIG. 5, with a base layer 18A, which features flexibility, and an adhesive layer 18B. Thus, work characteristics when the seal member 18 is being adhered to the casing can be improved. That is, a situation in which the toner cartridge 17 is electrostatically charged and attracts the seal member 18, and the seal member 18 sticks to an unintended location can be avoided.

Figure 6:
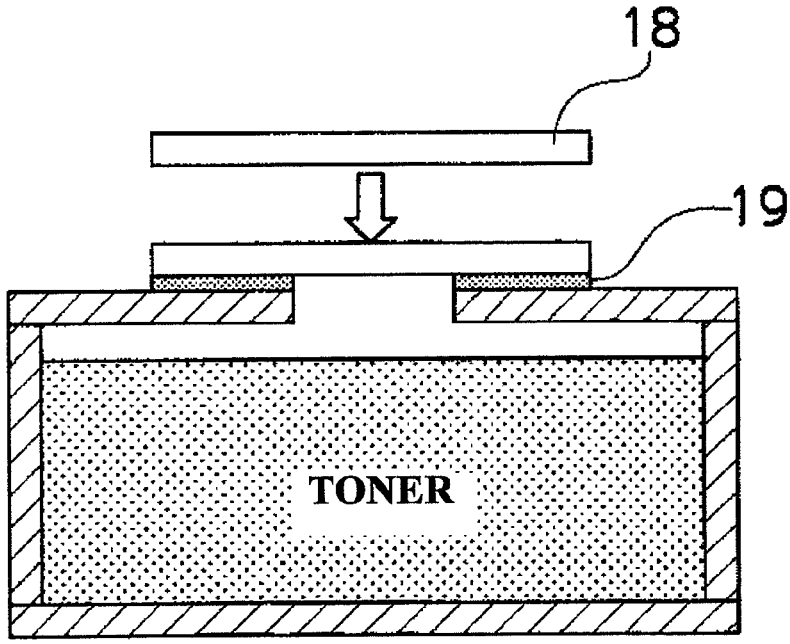
FIG. 6 is a view showing the toner cartridge pertaining to the present invention.

Further, by providing an adhesive member 19 at the periphery of the toner filling port 17A, as shown in FIG. 6, it is possible to increase strength of an adhesion portion, and to improve reliability in relation to preventing seal detachment and toner leakages.

Further yet, if the seal member 18 is formed with material(s)/color(s) with which a color of the toner inside the toner cartridge 17 can be identified, and an adhesion portion is provided even at a portion of the seal member 18 that does not contact with the casing body, it will be possible to easily identify the color of the toner that has been filled into the interior of the toner cartridge 17 from toner that adheres to the inner side of the seal member 18. More specifically, if the seal member 18 is formed to be transparent or a color close to transparency and is kept sufficiently thin, it will be possible to identify the color of the toner inside the toner cartridge 17 from the outside. In such a case, if the adhesion portion at the inner side of the seal member 18 is not provided, there will be no toner adhered to the inner side of the seal member 18 at the periphery of the toner filling port 17A, and identification of the toner inside the casing will be difficult. Therefore, for reliable identification of the color of the toner in the interior, it is necessary to provide the adhesion portion at the inner side of the seal member 18.

-Plural Filling Port-

Figure 7A:
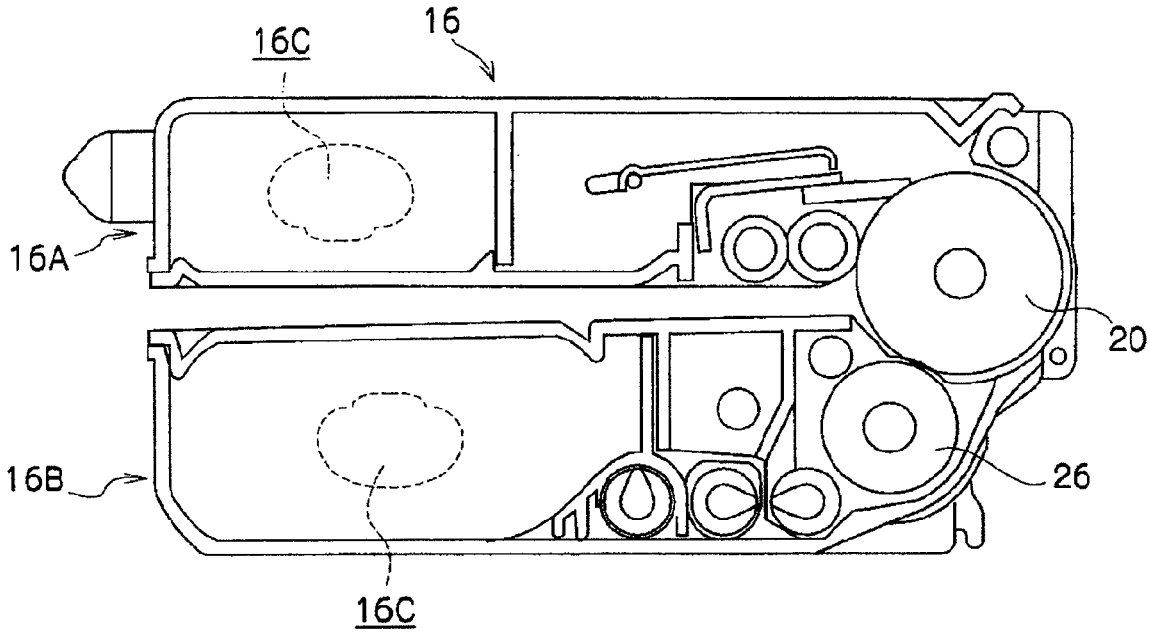
FIG. 7A is a view showing a developing unit pertaining to the present invention.
Figure 7B:
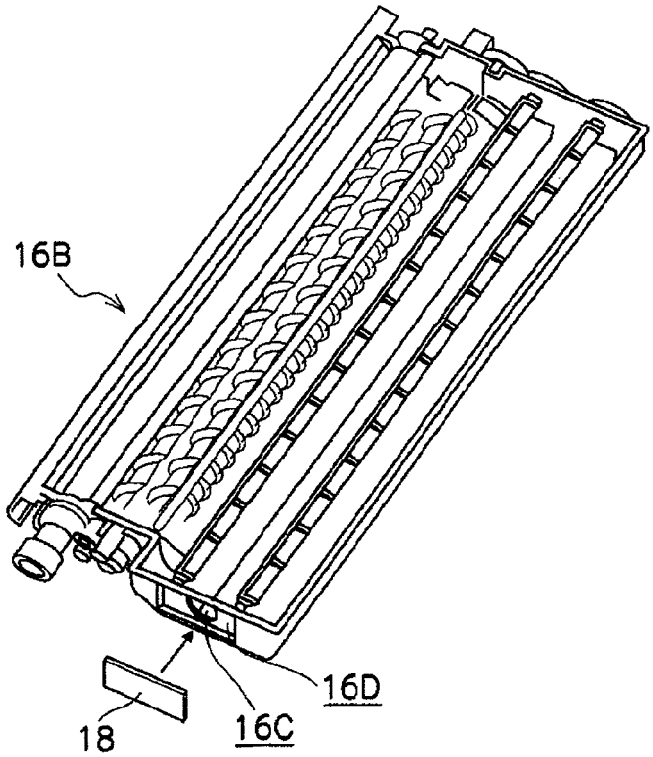
FIG. 7B is a view showing the developing unit pertaining to the present invention.

FIGS. 7A and 7B show a developing unit of an image forming apparatus pertaining to the present invention.

As shown in FIGS. 7A and 7B, the developing unit 16 is integrally provided with the image carrier 20, the developing roller 26 and suchlike, and constitutes a periodically replaceable component which can be replaced by a user. The developing unit 16 is filled with toner in advance, and when this toner has been consumed, the developing unit 16 is replaced. In the case of the developing unit 16 of FIGS. 7A and 7B, in order to increase a filling amount of toner by even a small amount, a first toner accommodation portion 16A and a second toner accommodation portion 16B are provided, at each of which a toner filling port 16C is provided. The first toner accommodation portion 16A and the second toner accommodation portion 16B are linked by an unillustrated communication port, and the toner is consumed from the second toner accommodation portion 16B side.

In such a case, because the toner filling ports 16C are formed as shown in FIG. 7A, the toner filling ports 16C are provided with sufficient opening areas without being restricted by the respective shapes and sizes of the first toner accommodation portion 16A and the second toner accommodation portion 16B.

Furthermore, as is shown in FIG. 7B, of outer peripheral faces of the second toner accommodation portion 16B, the toner filling port 16C is provided in a side face with a small area. Thus, by filling with the face in which the toner filling port 16C is formed being oriented upward during filling of toner, toner filling can be performed with high efficiency. Further, each toner filling port 16C is provided in a recess portion 16D and is reliably covered with the seal member 18. Therefore, toner leakages can be prevented.

-Abutting Position and Thickness-

Figure 8B:
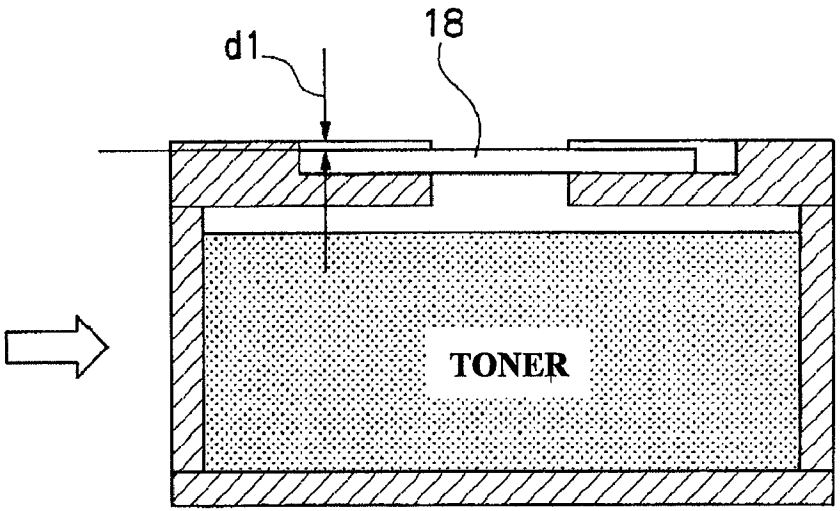
FIG. 8B is a view showing the toner cartridge pertaining to the second exemplary embodiment of the present invention.
Figure 8A:
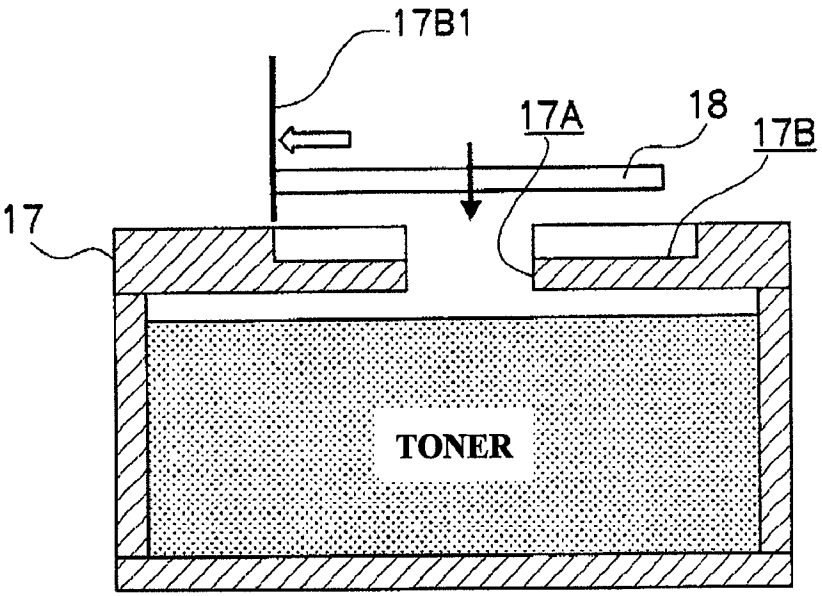
FIG. 8A is a view showing a toner cartridge pertaining to a second exemplary embodiment of the present invention.

FIGS. 8A and 8B show a toner cartridge of an image forming apparatus pertaining to a second exemplary embodiment of the present invention.

As shown in FIG. 8A, when the seal member 18 is to be adhered to the recess portion 17B, it is necessary for the seal member 18 to be filled in the shape of the recess portion 17B with a certain amount of play. Furthermore, an edge of the recess portion 17B can be utilized to improve accuracy of the adhesion position of the seal member 18.

That is, the present exemplary embodiment has a structure in which, as shown in FIG. 8A, the seal member 18 abuts against the edge marked as recess portion 17B1, and reliably covers the toner filling port 17A.

Furthermore, a thickness of the seal member 18 is set to less than a depth of the recess portion 17B. Thus, situations in which the seal member 18 is peeled off and/or lifted up by contact with external members can be prevented. That is, as shown in FIG. 8B, if the thickness of the seal member 18 and the depth of the recess portion 17B are specified such that there is a step difference d1 between a surface of the seal member 18 adhered to the recess portion 17B and the surroundings of the recess portion 17B, the seal member 18 will not protrude from the recess portion 17B when the toner cartridge 17 is being handled, and the surface of the seal member 18 will be recessed relative to the surface of surroundings of the seal adhesion portion. Therefore, an end portion of the seal member 18 is difficult to be touched, and even if an irregular operation is performed during processing of the toner cartridge 17 or the like, peeling of the seal can be prevented.

-Dirt Prevention-

FIGS. 9A to 9D show a toner cartridge of an image forming apparatus pertaining to a third exemplary embodiment of the present invention.

After toner has been filled into the toner cartridge 17, when the toner-filling machine 70 is withdrawn from the toner filling port 17A, there is a chance that toner will spill out from the distal end of the toner-filling machine 70 and adhere to the vicinity of the toner filling port 17A and contaminate the surroundings thereof. Moreover, adherence of toner to the surface of the adhesive material may lead to failures in adhesion of the seal member 18.

Figures 9A, 9B, 9C, 9D:
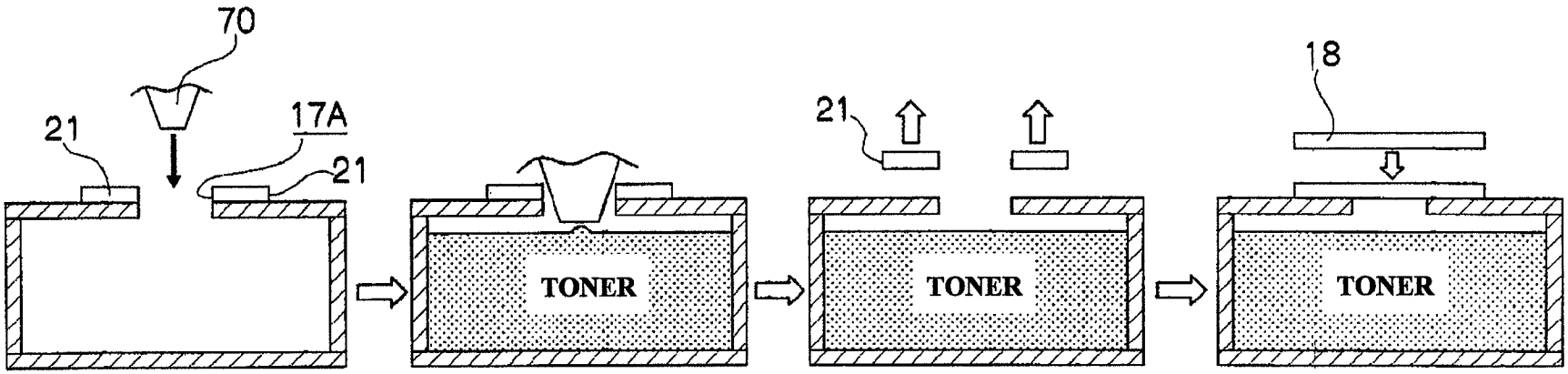
FIG. 9A is a view showing a filling process of a toner cartridge pertaining to a third exemplary embodiment of the present invention.
FIG. 9B is a view showing the filling process of the toner cartridge pertaining to the third exemplary embodiment of the present invention.
FIG. 9C is a view showing the filling process of the toner cartridge pertaining to the third exemplary embodiment of the present invention.
FIG. 9D is a view showing the filling process of the toner cartridge pertaining to the third exemplary embodiment of the present invention.

Accordingly, in the present exemplary embodiment, as shown in FIG. 9A, when the toner is being filled into the toner cartridge 17, a dirt adherence member 21 is disposed at surroundings of the toner filling port 17A. Thus, when the nozzle of the toner-filling machine 70 is to be taken out from the toner filling port 17A as shown in FIG. 9B, toner remaining at the distal end of the toner-filling machine 70 can be allowed to adhere to the dirt adherence member 21.

Therefore, even if toner is spilled onto the surroundings of the toner filling port 17A, when the dirt adherence member 21 is taken away as shown in FIG. 9C, the spilt toner is taken away together with the dirt adherence member 21. Therefore, a process for performing cleaning of toner that has adhered to the periphery of the toner filling port 17A need not be provided, in addition to which a reduction in adhesive force due to toner adhering to the adhesive portion of the seal member 18 can be prevented.

-Dirt Prevention and Adhesive Material-

FIGS. 10A to 10D show a toner cartridge of an image forming apparatus pertaining to a fourth exemplary embodiment of the present invention.

After toner has been filled into the toner cartridge 17, when the toner-filling machine 70 is withdrawn from the toner filling port 17A, there is a chance that toner will spill out from the distal end of the toner-filling machine 70 and adhere to the vicinity of the toner filling port 17A and contaminate the surroundings thereof, in addition to which adherence of toner to the surface of the adhesive material may lead to failures in adhesion of the seal member 18. Therefore, a dirt adherence member around the toner filling port 17A is provided, which is similar to the third exemplary embodiment.

The dirt adherence member 21 for the present exemplary embodiment is formed as a two-sided tape with a releasable sheet attachment, and can provide the same effects as the third exemplary embodiment at low cost.

Figures 10A, 10B, 10C, 10D:
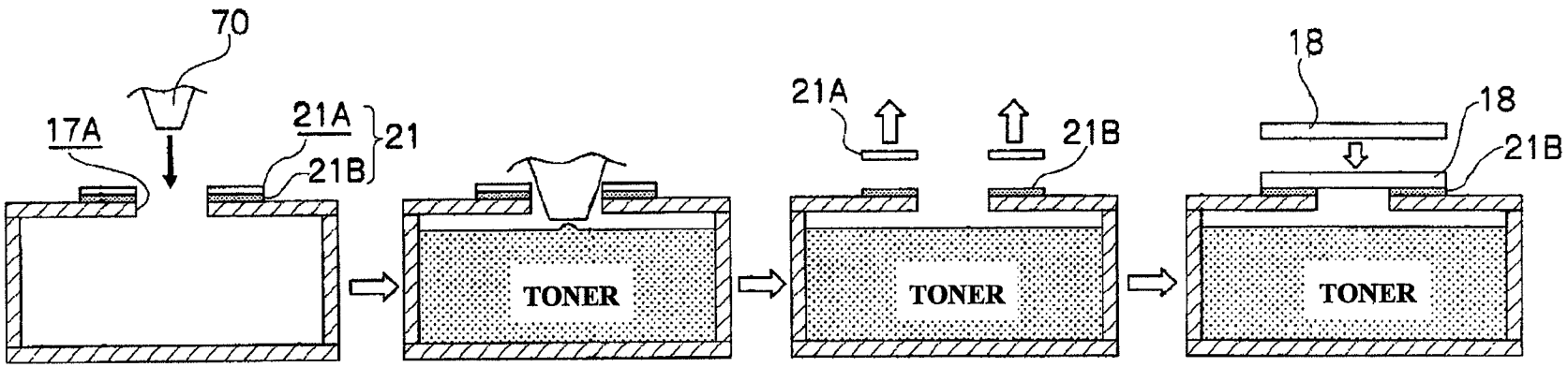
FIG. 10A is a view showing a filling process of a toner cartridge pertaining to a fourth exemplary embodiment of the present invention.
FIG. 10B is a view showing the filling process of the toner cartridge pertaining to the fourth exemplary embodiment of the present invention.
FIG. 10C is a view showing the filling process of the toner cartridge pertaining to the fourth exemplary embodiment of the present invention.
FIG. 10D is a view showing the filling process of the toner cartridge pertaining to the fourth exemplary embodiment of the present invention.

That is, as shown in FIG. 10A, when toner is being filled into the toner cartridge 17, because the dirt adherence member 21 is provided at the surroundings of the toner filling port 17A, when the nozzle of the toner-filling machine 70 is to be taken out from the toner filling port 17A as shown in FIG. 10B, toner remaining at the distal end of the toner-filling machine 70 can be allowed to adhere to the dirt adherence member 21.

Therefore, even if toner is spilled onto the surroundings of the toner filling port 17A, when a surface of the dirt adherence member 21 (a releasable sheet 21A) is taken away as shown in FIG. 10C, the spilt toner is taken away together with the releasable sheet 21A. Therefore, a process for performing cleaning of toner that has adhered to the periphery of the toner filling port 17A need not be provided, in addition to which a reduction in adhesive force due to toner adhering to the adhesive portion of the seal member 18 can be prevented.

In the present exemplary embodiment, the dirt adherence member 21 is a two-sided tape formed with the releasable sheet 21A and an adhesive material 21B, and the adhesive material 21B is left behind after the releasable sheet 21A has been removed as shown in FIG. 10C. It is possible to efficiently close off the toner filling port 17A by adhering the seal member 18 to the adhesive material 21B, as shown in FIG. 10D. Moreover, even if an adhesive layer is not provided at the seal member 18, the seal member 18 can be adhered by the adhesive material 21B. Thus, the seal member 18 can be substituted with a simple sheet, and a reduction in costs enabled.

-Dirt Adherence Member and Abutting Position-

Figure 11B:
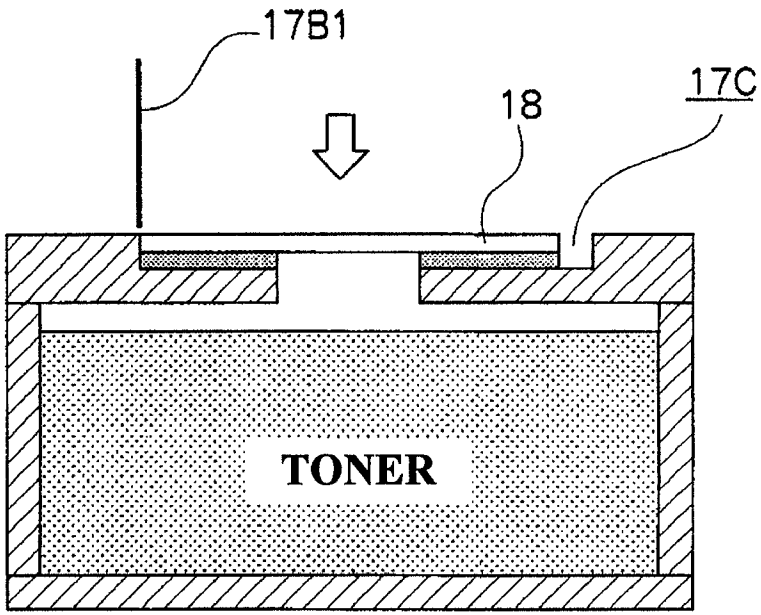
FIG. 11B is a view showing the toner cartridge pertaining to the fifth exemplary embodiment of the present invention.
Figure 11A:
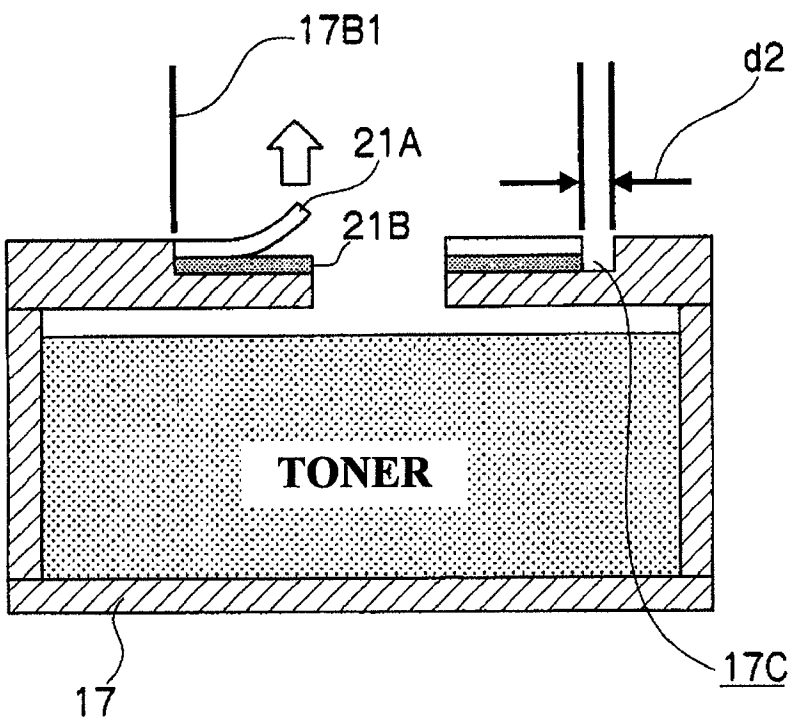
FIG. 11A is a view showing a toner cartridge pertaining to a fifth exemplary embodiment of the present invention.
Figures 12A, 12B, 12C:
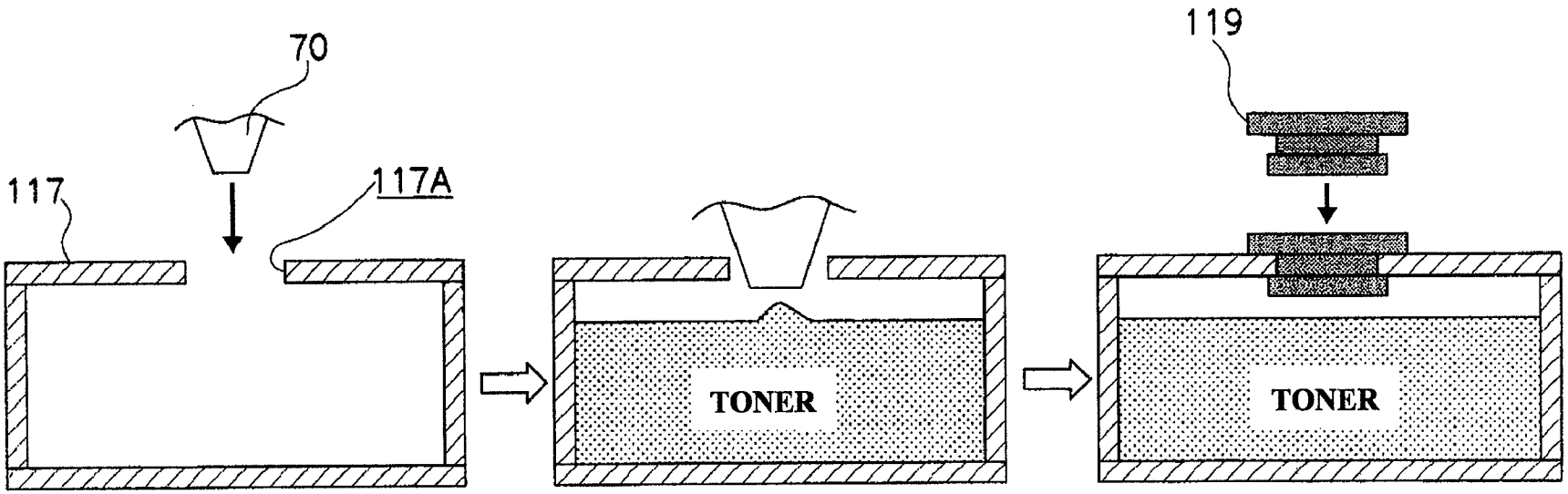
FIG. 12A is a view showing a filling process of a previous toner cartridge.
FIG. 12B is a view showing the filling process of the previous toner cartridge.
FIG. 12C is a view showing the filling process of the previous toner cartridge.

FIGS. 11A and 11B show a toner cartridge of an image forming apparatus pertaining to a fifth exemplary embodiment of the present invention.

As shown in FIG. 11A, when the dirt adherence member 21 is to be adhered to the recess portion 17B, the dirt adherence member 21 can be abutted against the edge marked as the recess portion 17B1, and the dirt adherence member 21 can be reliably adhered at an adhesion position. That is, by employing the edge marked as the recess portion 17B1 for positional regulation of the dirt adherence member 21, as the same is employed for positional regulation of the seal member 18 in the second exemplary embodiment, it is possible to raise positional accuracy of the dirt adherence member 21.

Further, when the two-sided tape is employed as the dirt adherence member 21, similarly to the fourth exemplary embodiment, and is abutted against the edge marked as the recess portion 17B1, if the size of the recess portion 17B and size of the dirt adherence member 21 are specified such that there is a margin with width d2 at the opposite side from the recess portion 17B1, a gap 17C will be formed at one end of the dirt adherence member 21, as shown in FIG. 11A.

Consequently, when the releasable sheet 21A of the dirt adherence member 21 (the two-sided tape) is to be peeled off, it is easy to engage a fingernail in the gap 17C, the releasable sheet 21A is easy to be peeled off, and work characteristics are improved.

-Other Matters-

Note that the present invention is not limited to the exemplary embodiments described above. The above exemplary embodiments have been described for a toner container such as a toner cartridge, a developing unit or the like for electrophotography, but there is no impediment to any mode as long as it is a container which accommodates developer including toner.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner container which is mountable and removable at a main body of an image forming apparatus, the toner container comprising:

at least one toner filling port provided in a casing body of the toner container;

an air vent port provided adjacent to the toner filling port and venting air from the casing body, the air vent being formed in a shape in which each segment connecting two points on two circles whose dimensions are different from each other are common between the two circles; and a sealing member which covers the toner filling port, the air vent port, and a predetermined area of surroundings of the toner filling port and the air vent port, from an outer side of the casing body, for sealing toner inside the casing body, wherein the sealing member includes transparency enabling identification of a color of the toner inside the casing body, and the sealing member includes an adhesive portion at a portion which covers the toner filling port and the air vent port, wherein the adhesive portion at a portion which covers the toner filling port and the air vent port is provided at an inner side of the casing body, such that the toner in the casing body adheres to the adhesive portion, wherein the toner filling port and the air vent port are provided in a side surface disposed at one end of a longitudinal direction, wherein the side surface having the longitudinal direction does not have the largest area among all planar sides that compose the toner container.

2. The toner container of claim 1, wherein an adhesive portion is provided at the surroundings of the toner filling port.

3. The toner container of claim 1, wherein the sealing member is structured with a base material including flexibility and an adhesive layer.

4. The toner container of claim 1, wherein the toner filling port and the predetermined area of the surroundings of the toner filling port are recessed as a recess portion relative to an outer surface adjoining the predetermined area, wherein a step difference between the recess portion and the outer surface of the toner container is equal to or more than a thickness of the sealing member.

5. The toner container of claim 1, wherein a shape of the toner filling port is a shape other than a circle.

6. An image forming apparatus comprising the toner container of claim 1.

7. A toner container which is mountable and removable at a main body of an image forming apparatus, the toner container comprising:

at least one toner filling port provided in a casing body of the toner container;

an air vent port provided adjacent to the toner filling port and venting air from the casing body, the air vent being formed in a shape in which each segment connecting two points on two circles whose dimensions are different from each other are common between the two circles; and a sealing member which covers the toner filling port, the air vent port, and a predetermined area of surroundings of the toner filling port and the air vent port, from an outer side of the casing body, for sealing toner inside the casing body; and an air vent for releasing air from inside the casing body, the toner filling port and the air vent both being covered with the sealing member, wherein the sealing member includes transparency enabling identification of a color of the toner inside the casing body, and the sealing member includes an adhesive portion at a portion which covers the toner filling port and the air vent port, wherein the adhesive portion at a portion which covers the toner filling port and the air vent port is provided at an inner side of the casing body, such that the toner in the casing body adheres to the adhesive portion, wherein a shape of the toner filling port is a shape other than a circle; or a shape formed by the toner filing port and the air vent being provided so as to be linked to the toner filling port is a shape other than a circle, wherein the toner filling port and the air vent port are provided in a side surface disposed at one end of a longitudinal direction, wherein the side surface having the longitudinal direction does not have the largest area among all planar sides that compose the toner container.

8. The toner container of claim 7, wherein the air vent is adjacent to the toner filling port.

* * * * *